US008316782B2

(12) United States Patent
Malaubier et al.

(10) Patent No.: US 8,316,782 B2
(45) Date of Patent: Nov. 27, 2012

(54) INDIRECT HEATING SYSTEM WITH UPGRADING OF ULTRA-FINE FUEL PARTICLES

(75) Inventors: François Malaubier, Le Plessis Robinson (FR); Jean-Michel Tornier, Villiers St Frederic (FR)

(73) Assignee: ALSTOM Technology Ltd, Baden (CH)

( * ) Notice: Subject to any disclaimer, the term of this patent is extended or adjusted under 35 U.S.C. 154(b) by 495 days.

(21) Appl. No.: 10/538,701

(22) PCT Filed: Nov. 26, 2003

(86) PCT No.: PCT/FR03/50133

§ 371 (c)(1),
(2), (4) Date: Nov. 18, 2005

(87) PCT Pub. No.: WO2004/055435

PCT Pub. Date: Jul. 1, 2004

(65) Prior Publication Data

US 2006/0254483 A1 Nov. 16, 2006

(30) Foreign Application Priority Data

Dec. 11, 2002 (FR) ..... 02 15626

(51) Int. Cl.
*F23D 1/00* (2006.01)
*F23K 3/02* (2006.01)
*F23K 1/00* (2006.01)

(52) U.S. Cl. ..... 110/104 B; 110/347; 110/106

(58) Field of Classification Search ..... 431/187, 431/188, 284; 239/424; 110/261–264, 104 B, 110/203, 106, 347

See application file for complete search history.

(56) References Cited

U.S. PATENT DOCUMENTS

| | | | | |
|---|---|---|---|---|
| 2,053,340 A | | 9/1936 | Kennedy | 110/104 |
| 2,057,450 A | * | 10/1936 | Schrenk | 122/2 |
| 2,083,126 A | * | 6/1937 | Shuman | 110/104 R |
| 2,427,903 A | * | 3/1944 | Crites | 241/33 |
| 4,092,094 A | * | 5/1978 | Lingl, Jr. | 432/1 |
| 4,250,820 A | | 2/1981 | Lautenschlager | 110/347 |
| 4,253,403 A | * | 3/1981 | Vatsky | 110/104 B |

(Continued)

FOREIGN PATENT DOCUMENTS

DE 3731271 A 4/1989

(Continued)

OTHER PUBLICATIONS

International Search Report—May 3, 2004.

*Primary Examiner* — Kenneth Rinehart
*Assistant Examiner* — Timothy K Trieu
(74) *Attorney, Agent, or Firm* — Robert D. Crawford

(57) ABSTRACT

The invention relates to an indirect heating system in which a solid fuel circulates in the form of particles. The inventive system comprises a grinding station, a furnace (7), at least one intermediate silo, a separator, at least one cyclone and, optionally, a gas recirculation fan. The invention is characterized in that a dust extractor (10) captures the finest particles which are subsequently introduced into the furnace (7) by means of at least one specific conduit (52) and burnt by at least one specific burner (71). The aforementioned ultra-fine particles are then stored in a specific silo (10), dosed into a feeding device (61), mixed in well defined proportions with hot air and conveyed to the specific burner (71) through the specific conduit (52).

18 Claims, 5 Drawing Sheets

U.S. PATENT DOCUMENTS

| | | | | | |
|---|---|---|---|---|---|
| 4,270,895 | A | * | 6/1981 | Vatsky | 431/183 |
| 4,438,709 | A | * | 3/1984 | Borio et al. | 110/347 |
| 4,465,495 | A | * | 8/1984 | Scheffee | 44/280 |
| 4,838,185 | A | * | 6/1989 | Flament | 110/347 |
| 4,919,611 | A | * | 4/1990 | Flament | 431/350 |
| 6,360,680 | B1 | | 3/2002 | Breen et al. | 110/345 |
| 6,369,680 | B1 | * | 4/2002 | Brinckmann et al. | 336/60 |
| 6,415,743 | B2 | * | 7/2002 | Malaubier et al. | 122/4 D |

FOREIGN PATENT DOCUMENTS

| | | | | |
|---|---|---|---|---|
| DE | 3841874 | | * | 8/1989 |
| DE | 3841874 | A | | 8/1989 |
| DE | 19623209 | C | | 6/1996 |
| EP | 0747629 | A1 | | 12/1995 |
| EP | 747629 | | * | 11/1996 |
| EP | 0976977 | A | | 7/1998 |
| EP | 976977 | | * | 2/2000 |
| FR | 2534359 | | * | 10/1983 |
| FR | 2534359 | A | | 4/1984 |

* cited by examiner

PRIOR ART

PRIOR ART

INDIRECT HEATING SYSTEM WITH UPGRADING OF ULTRA-FINE FUEL PARTICLES

RELATED APPLICATIONS

The present application is a national phase application of PCT/FR2003/050133, which in turn claims the benefit of priority from French Patent Application No. 02 15626, filed on Dec. 11, 2003, the entirety of which are incorporated herein by reference.

FIELD OF THE INVENTION

The present invention relates to indirect heating systems designed to burn solid fuels.

BACKGROUND OF THE INVENTION

Such systems are characterized by the provision of an intermediate silo reserved for pulverized fuel between the solid fuel grinding station and the combustion chamber. This type of system is used for fuels that are difficult to burn, such as anthracite or fuels low in volatile material (e.g. low volatile bituminous coal as defined by the ASTM), since it clearly separates and optimizes the grinding of the solid fuel, on the one hand, and the combustion of said pulverized fuel, on the other hand.

There are a number of types of indirect heating system: those which return the exhaust (products obtained by separating the pulverized fuel and the gases used to dry and transport said fuel) to the combustion chamber and those which reject the exhaust to the atmosphere.

These systems operate in the following manner: the solid fuel, for example coal, is stored in a silo and conveyed to a grinder in which it is ground and dried by very hot air or gas. The pulverized fuel is then transported pneumatically to a separator, which intercepts the coarse particles and returns them to the inlet of the grinder, and thence into one or more cyclones which intercept the pulverized fuel and discharge it into an intermediate storage silo; ducts and possibly a gas recirculation fan complete the installation.

The grinding system receives hot air and gases for drying the untreated fuel. The hot gases and those produced by the evaporation of the moisture from the fuel are surplus and must therefore be extracted via dedicated ducting known as exhaust ducting. All these circuits operate at a low temperature (approximately 100° C.).

The cyclone does not intercept all of the fine solid fuel particles in the surplus gases, and it is therefore necessary to treat these particles. The usual concentrations of solid fuel in the gases are of the order of 50 g/m$^3$ to 200 g/m$^3$.

The ultrafine particles can either be sent to the combustion chamber by a fan (return of exhaust to the combustion chamber) or intercepted in a dust extractor such as an electrostatic dust extractor or a bag filter and discharged into the intermediate silo, where they are mixed with the other particles from the cyclone (rejection of exhaust to the atmosphere).

These techniques are satisfactory for most fuels, but they perform much less well for the fuels lowest in volatile material. In particular, it is necessary to introduce noble fuels such as fuel oil or natural gas to support combustion at low loads.

If the exhaust is returned to the combustion chamber, the gases transporting the ultrafine particles are essentially inert gases, such as water vapor caused by evaporation of the moisture from the fuel, and because they come from hot combustion gases taken from the combustion chamber to dry the untreated fuel these gases have high concentrations of $CO_2$ and low concentrations of $O_2$. Moreover, the concentration of fuel particles in the gases is far from the optimum required for good combustion.

Combustion of the particles is all the more difficult to achieve in that a compromise must be found between injecting particles sufficiently near the main flame for the ignition of the ultrafine particles to benefit from the high temperatures in this area and sufficiently far from the flame for the latter not to be disturbed by the mass of relatively cold inert gases injected with the ultrafine particles. Choosing the injection area is therefore particularly difficult and requires very considerable experience.

If the exhaust is rejected to the atmosphere, in the case of fuels which are difficult to burn because they are lower in volatile materials, the ultrafine particles from the dust extractor are mixed with the coarser fuel in the intermediate silo, and these improved particles therefore cannot be exploited.

OBJECTS AND SUMMARY OF THE INVENTION

The object of the invention is to propose a heating system which allows the recovery and specific use of improved ultrafine particles (i.e. ultrafine particles of improved combustion quality), resulting from the passage of the pulverized fuel through the cyclone, and which reduces the technical minimum of the system without noble fuel support and reduces NOx emissions.

The indirect heating system according to the invention is a system in which a solid fuel circulates in the form of particles, and includes a grinding station, a combustion chamber, at least one intermediate silo, a separator and at least one cyclone, and is characterized in that a dust extractor intercepts the finest particles which are then introduced into the combustion chamber via at least one dedicated pipe and burned by at least one dedicated burner. The dedicated burners are preferably in the area of the main burners. The ultrafine particles are stored in a dedicated silo, metered by a feeder, mixed in clearly defined proportions with hot air or gases, and then transported to the dedicated burners by the dedicated pipes. The injector of the dedicated burner preferably has a rectangular or circular section.

Thus the fuel to air ratio for transporting the particles to the burner can be from 5 kg of fuel per 1 kg of air to 1 kg of fuel per 2 kg of air, whereas on injection into the burners, because of additional injection of hot air, the ratio can be of the order of 1.5 kg of fuel per 1 kg of air to 1 kg of fuel per 2 kg of air. The hot air is called primary air and its temperature is of the order of 250° C. to 500° C.; for fuels that are particularly difficult to burn, such as meta-anthracite, the temperature is greater than 400° C. On reaching the main burners, the mixture of hot air or gases and pulverized fuel is at a temperature of the order of 200 to 380° C., depending on the proportions of the fuel/air mixture. This high temperature is highly favorable to ignition of the fuel and to stabilization of the burner flame.

According to one particular feature, the dedicated burners are near the main burners. The use of improved ultrafine particles produces a high quality flame which stabilizes the combustion of the main burners, which in turn reduces the minimum charge possible without noble fuel support. Thanks to this, a saving is made in the fuel costs, because solid fuel is less costly than noble fuels such as fuel oil or natural gas. The saving is greater if the installation is required to operate more often at low load.

According to another feature, each series of main burners has at least two dedicated burners. The number of dedicated burners is chosen to suit the individual application, but there are at least two dedicated burners for each series of main burners to guarantee a good distribution of the various fuels. In the case of a double vault or front heating combustion chamber, at least two dedicated burners are used, whereas in the case of a tangential heating combustion chamber a single dedicated burner is sufficient.

The indirect heating system according to the invention is a system in which a solid fuel circulates in the form of particles, the system including a grinding station, a combustion chamber, at least one intermediate silo, a separator, at least one cyclone and possibly a gas recirculation fan, and is characterized in that a dust extractor intercepts the finest particles which are then introduced into the combustion chamber via dedicated pipes and injectors downstream of the main burners. The method of metering the ultrafine particles and hot air is similar to that used previously, but the particles are fed to new injectors situated outside the main combustion area and disposed so that their flames mix with the main burner flame tails.

According to one particular feature, the finest particles are injected under substoichiometric conditions. Injection of the ultrafine particles under these conditions downstream of the burners favors the lowering of nitrogen oxide (NOx) emissions. Unlike the conventional method of returning the exhaust to the combustion chamber, in which the nature and the flowrate of the transport gases result from the operating conditions of the grinding circuits, the nature and the flowrate of the transport gases for the system according to the invention are chosen for substoichiometric combustion of the ultrafine particles.

According to another feature, the intercepted particles have a diameter less than 75 microns. They are significantly smaller than the pulverized fuel circulating in the heating system.

According to another feature, the intercepted particles have a true mass per unit volume from 0.1 kg/dm$^3$ to 0.4 kg/dm$^3$ lower than that of the particles intercepted by the cyclone. This difference is explained by the fact that the cyclone preferably intercepts particles rich in the heaviest elements, i.e. in mineral materials and in particular in pyrites. In other words, the quality of the ultrafine fuel has been "improved". The particles recovered in the dust extractor are not only much finer than the main mass of fuel recovered in the silo, but also have a different chemical analysis, with a lower ash content, and therefore a higher content of combustible materials (fixed carbon and volatile materials) than the main fuel recovered in the silo.

According to one particular feature, some of the intercepted particles are introduced into injectors downstream of the burners. The combination of dedicated burners and downstream injectors allows use of the ultrafine particles in the dedicated burners, in the downstream injectors or simultaneously in both types of injector. For example, the dedicated burners are used for low loads on the heating system and the downstream injectors are additionally put into service for a higher load on the system. It is therefore possible to reduce the minimum load without noble fuel support and therefore to make a saving because the cost of solid fuel is much lower than that of noble fuels such as fuel oil or natural gas. The saving is all the greater if the installation is called upon to operate more frequently at low load.

In a first variant, the combustion chamber is a double vault combustion chamber. In this heating system the main burners and the dedicated burners are situated in the vaults. This type of combustion chamber is used to burn anthracite or non-bituminous coal.

In a second variant, the combustion chamber is a front heating combustion chamber. The main burners and the dedicated burners are placed on at least one of the walls of the combustion chamber.

In a third variant, the combustion chamber is a tangential heating combustion chamber. In this case, the main burners and the dedicated burners are in the corners of the combustion chamber. The dedicated burners could be in the corners between the main burners or on the faces of the combustion chamber near the main burners. The downstream injectors are above the main burners, either in the corners or on the faces of the combustion chamber.

According to another feature, the solid fuel is non-bituminous coal. This is difficult to burn without using an external fuel because it is low in volatile materials and gives off large amounts of NOx. The system valorizes the ultrafine particles and therefore improves the combustion of non-bituminous coal.

BRIEF DESCRIPTION OF THE DRAWINGS

The invention will be better understood after reading the following description, which is given by way of example only and with reference to the accompanying drawings, in which.

DETAILED DESCRIPTION

Figure 1:
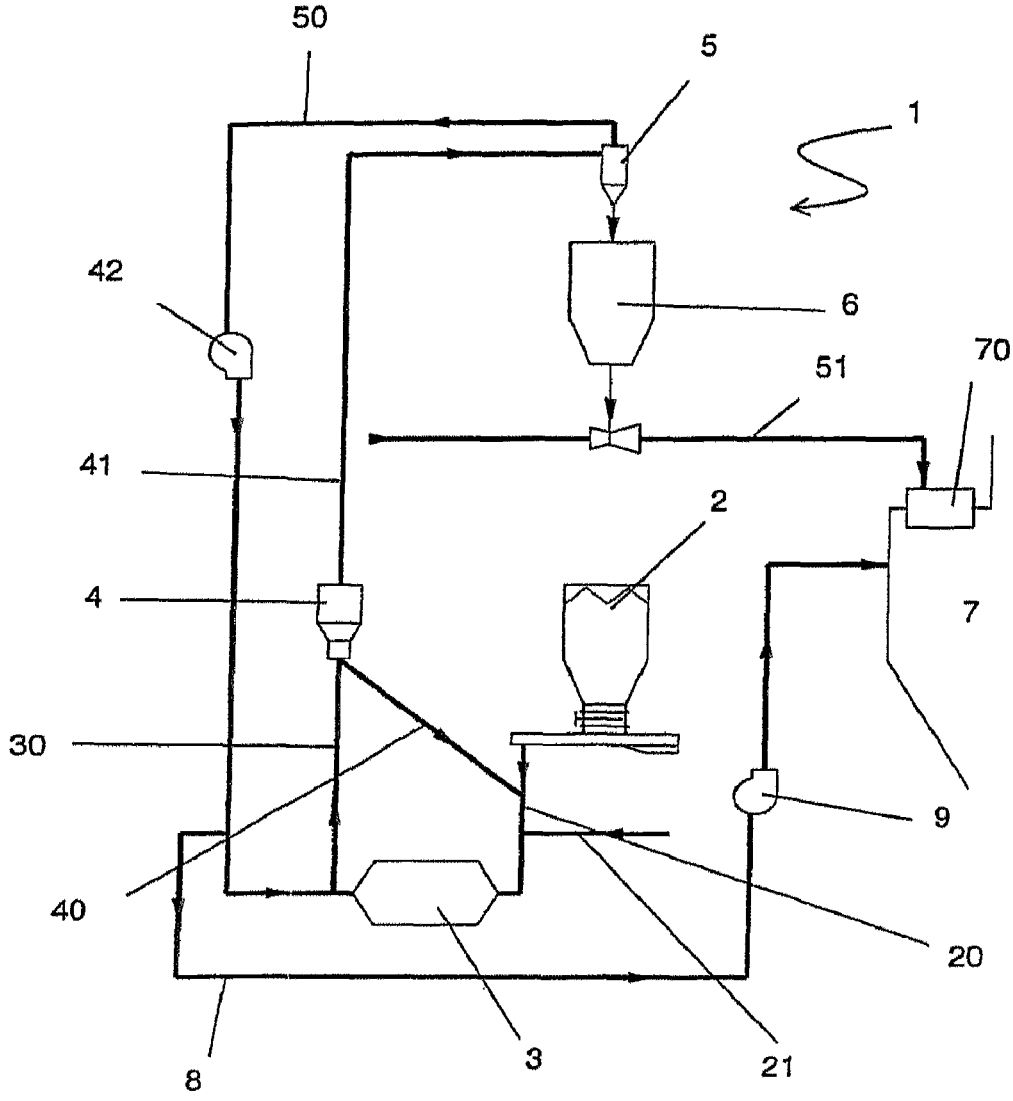
FIG. 1 is a view of a prior art indirect heating system which returns the exhaust to the combustion chamber.

The same reference numbers are used for parts with the same function in the different variants.

Existing indirect heating systems 1 (FIGS. 1 and 2) include a silo 2 in which untreated fuel is stored and a grinder 3 which the untreated fuel reaches via a pipe 20 and where it is ground and dried by very hot air or gases arriving via the pipe 21. The resulting pulverized fuel is transported pneumatically by a pipe 30 to a separator 4 which intercepts only the coarse particles and returns them to the inlet of the grinder 3 via a pipe 40. The other particles are sent by a pipe 41 to one or more cyclones 5 whose function is to intercept the pulverized fuel, which is then discharged into an intermediate storage silo 6 and thereafter sent by a pipe 51 to main burners 70 in the combustion chamber 7 to be burned. The gases leaving the cyclone 5 are returned to the circuit via ducting 50 and a fan 42.

The grinding system receives the hot air or gases via the ducting 21 and itself produces surplus gases, such as water vapor resulting from the evaporation of the moisture in the fuel, and to operate correctly the system must therefore extract the gases via ducting 8 called the exhaust ducting.

The cyclone 5 may not have a fine particle intercept efficiency of 100%, the latter particles being found with the excess gases that are returned to the circuit by the fan 42 in the ducting 50. The usual concentrations of solid fuel are of the order of 50 g/m$^3$ to 200 g/m$^3$.

In FIG. 1, the particles are returned to the combustion chamber 7 via a fan 9 and the ducting 8.

Figure 2:
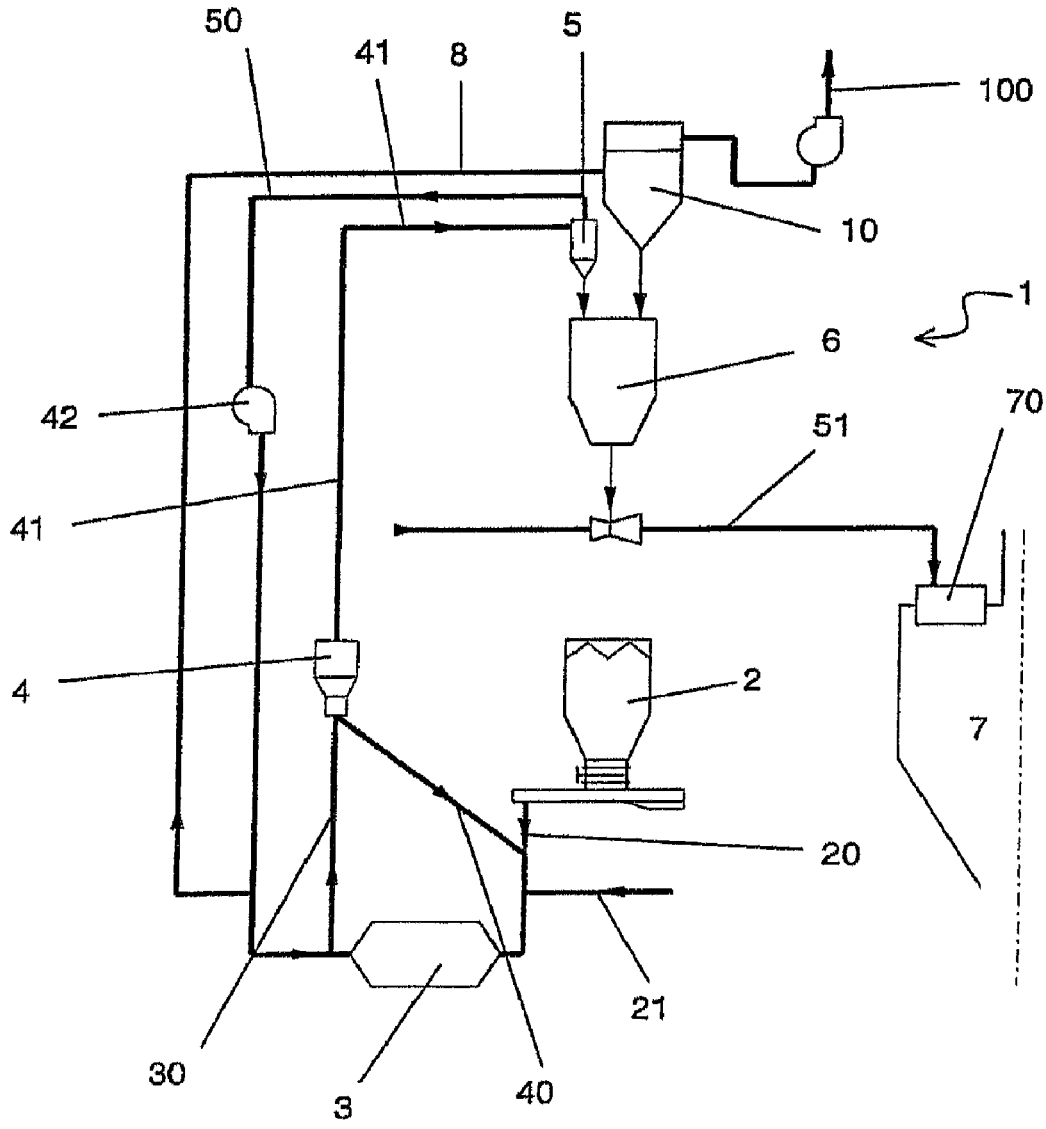
FIG. 2 is a view of another prior art indirect heating system which rejects the exhaust to the atmosphere.

In FIG. 2, the fine particles contained in the gases from the ducting 8 are intercepted by a dust extractor 10 of the electrostatic dust extractor or bag filter type and the ultrafine particles are then discharged into the silo 6, where they are mixed with other particles already recovered by the cyclone 5, and the gases are rejected to the atmosphere via the pipe 100.

Figure 3:
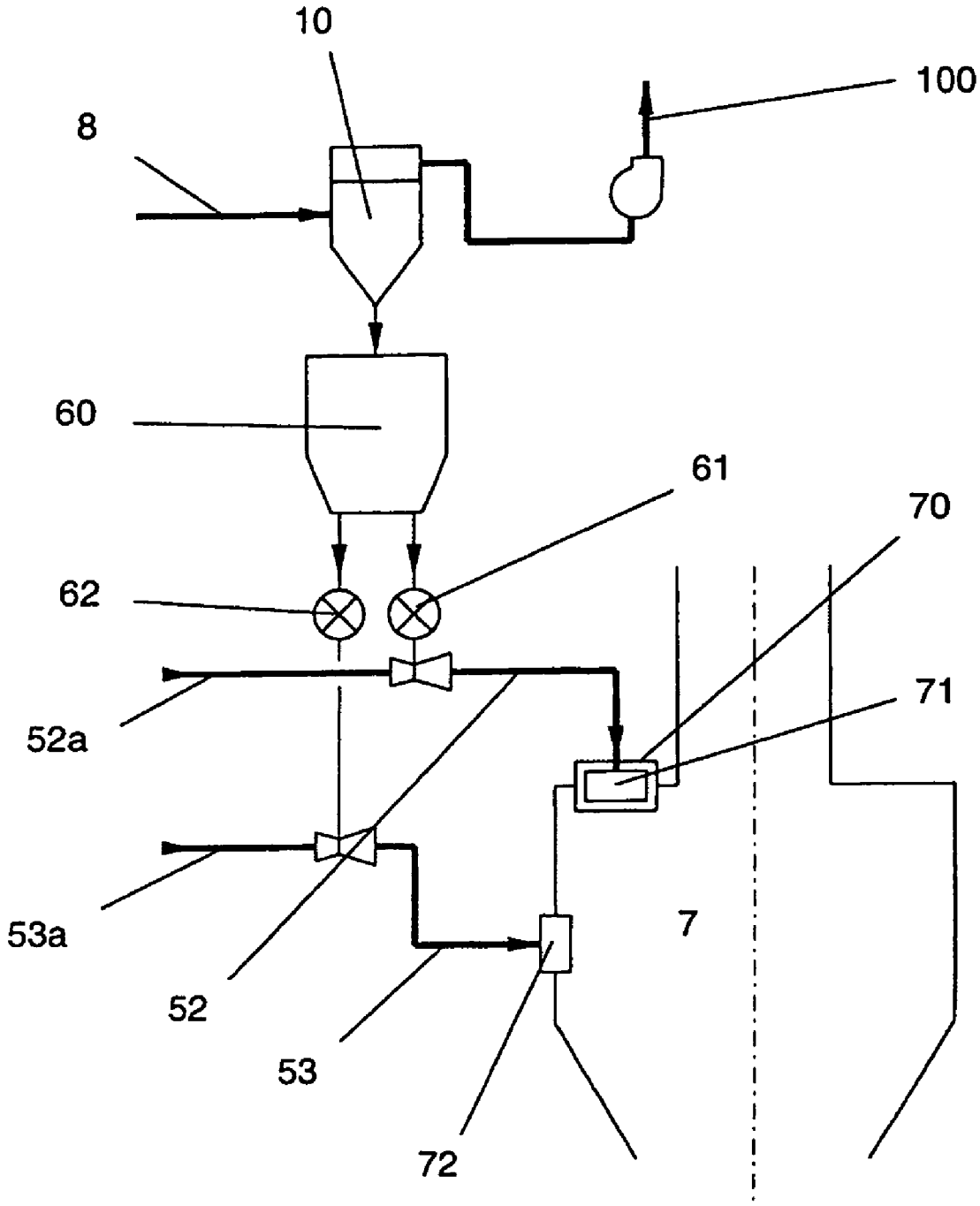
FIG. 3 is a view of a heating system according to the invention with a double vault combustion chamber.
Figure 4:
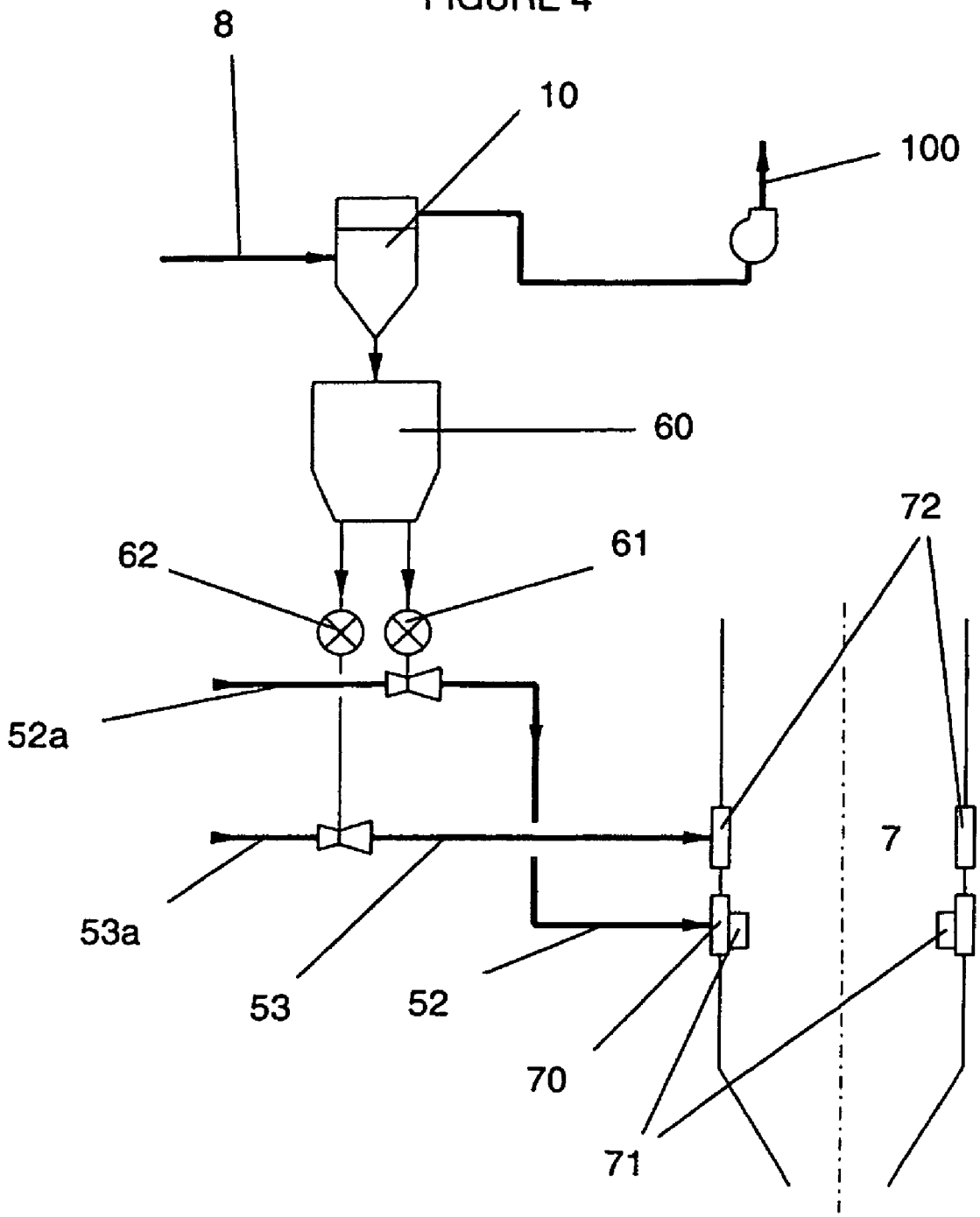
FIG. 4 is a view of a heating system according to the invention with a front or tangential heating combustion chamber.

In the indirect heating system shown in FIGS. 3 and 4, a second silo 60 receives the ultrafine particles, which are then directed by ducting 52 or 53 toward the combustion chamber 7, in which they are burned.

The ultrafine particles are burned either in dedicated burners 71 or in dedicated injectors 72.

The system according to the invention operates in the following manner: the ground fuel particles that escape intercept by the cyclone 5 are directed toward the dust extractor 10 by the ducting 8, the gases are rejected to the atmosphere via the ducting 100, and the ultrafine particles are stored in the additional silo 60. Some of the particles in the silo 60 are sent to the burners 71 via the ducting 52 and the remainder are sent to the injectors 72 via the ducting 53.

Figure 5:
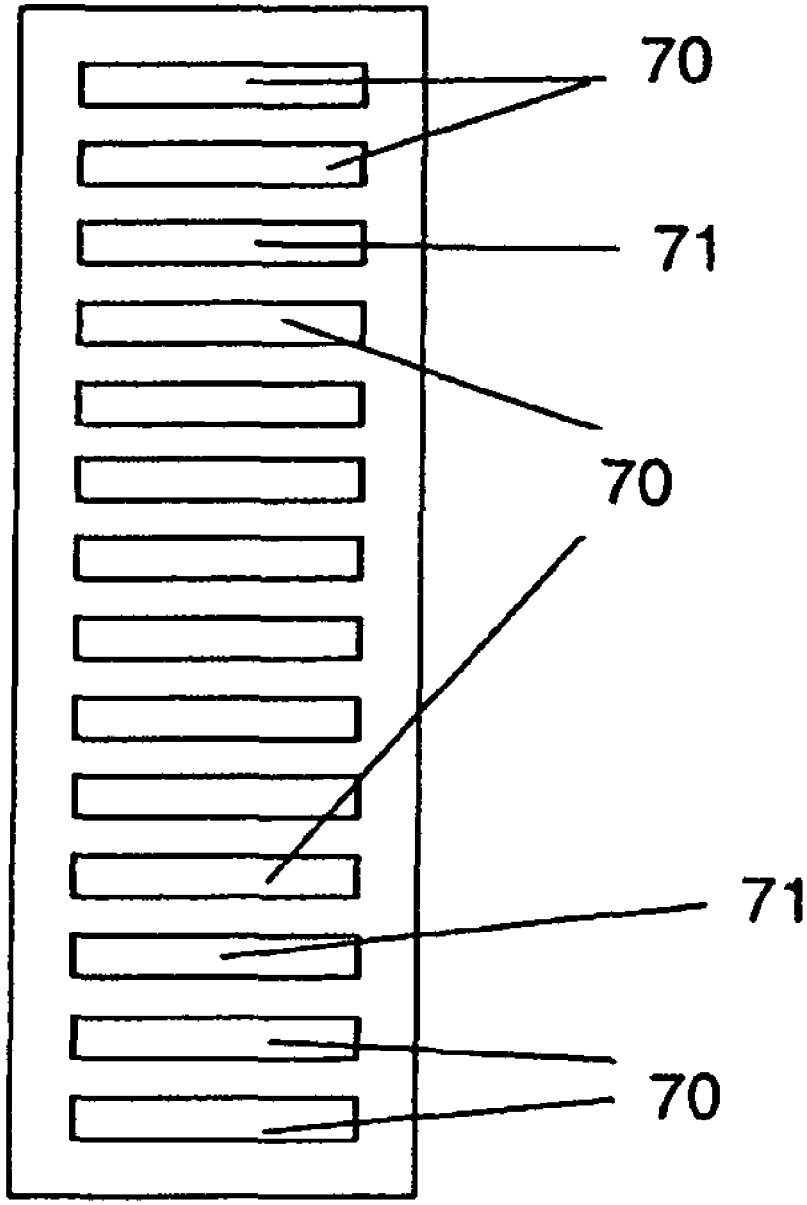
FIG. 5 is a detailed view of the burners.

The dedicated burners 71 are near the main burners 70; as shown in FIG. 5, the main burners 70 are aligned in series and the dedicated burners 71 are disposed either on respective opposite sides of each series or between the burners 70.

In the case of tangential heating, as shown in FIG. 4, the burners 71 can be either in the corners of the combustion chamber 7 or on the faces of the combustion chamber 7 near the main burners 70.

Feeders 61 and 62 meter the quantity of ultrafine particles to allow them to be transported in the ducting 52 and 53.

The particles are transported by hot air or gases arriving via the pipes 52*a* and 53*a*. Additional injection of hot air or gas (not shown) at the level of the dedicated burners 71 is possible. This makes it possible to adjust the concentration of the fuel.

The invention claimed is:

1. An indirect heating system in which a solid fuel circulates in the form of particles, comprising:

a grinding station that grinds the solid fuel into coarse particles that require re-grinding, fine particles having an average diameter smaller than the coarse particles, but larger than 75 microns and particles having an average diameter less than 75 microns referred to as 'ultrafine particles', and releases them as a stream of flowing particles;

a separator receives the stream from the grinding station and intercepts the coarse particles from the stream passing them back to the grinding station;

an intermediate silo adapted to store fine particles, at least one main burner adapted to burn fine particles;

at least one cyclone that receives the stream from the separator, and intercepts the fine particles from the stream and stores the fine particles in an intermediate silo, until they are provided to the main burner; and a dust extractor receives the stream after the cyclone and intercepts the ultrafine particles from the stream;

at least one dedicated burner adapted to burn ultrafine particles;

a second intermediate silo that receives the ultrafine particles from the dust extractor, wherein the ultrafine particles are then provided by a dedicated pipe to the dedicated burner for burning in the combustion chamber; and a feeder that controls the amount of ultrafine particles provided from the second intermediate silo to the dedicated burner.

2. The heating system according to claim 1, wherein the dedicated burner is near the main burner.

3. The heating system according to claim 2, wherein the ultrafine particles are provided by a plurality of dedicated pipes to respective dedicated burners, each of the dedicated burners being near a respective main burner.

4. The heating system according to claim 1, wherein the ultrafine particles have a true mass per unit volume from 0.1 $kg/dm^3$ to 0.4 $kg/dm^3$ lower than that of the fine particles intercepted by the cyclone.

5. The heating system according to claim 1, wherein the combustion chamber is a double vault combustion chamber, a front heating combustion chamber, or tangential heating combustion chamber.

6. The heating system according to claim 1, wherein the solid fuel is non-bituminous coal.

7. The heating system according to claim 1, wherein the dust extractor includes a bag filter or an electrostatic dust extractor.

8. The heating system according to claim 1, wherein the ultrafine particles are mixed with a hot gas.

9. The heating system according to claim 1, wherein the ultrafine particles have a higher content of combustible material than the fine particles.

10. An indirect heating system in which a solid fuel circulates in the form of particles, having an intermediate silo adapted to store the particles and a main burner adapted to burn the particles, comprising:

a grinding station that grinds the solid fuel into coarse particles, fine particles and particles having a diameter that are less than 75 microns referred to as 'ultrafine particles' and releases them as a stream of flowing particles;

a separator receives the stream from the grinding station and intercepts the coarse particles from the stream;

at least one cyclone receives the stream from the separator, and intercepts the fine particles from the stream that are provided to said intermediate silo that stores fine particles until they are provided to said main burner to be burned in a combustion chamber;

a dust extractor receives the stream after the cyclone and intercepts the ultrafine particles from the stream;

at least one dedicated injector adapted to burn ultrafine particles;

a second intermediate silo that receives the ultrafine particles from the dust extractor, wherein the ultrafine particles are then provided by a dedicated pipe to the at least one dedicated injector for burning in the combustion chamber; and a feeder that controls the amount of ultrafine particles provided from the second intermediate silo to the dedicated injector.

11. The heating system according to claim 10, wherein the ultrafine particles are injected under substoichiometric conditions.

12. The heating system according to claim 10, wherein the fine particles are provided to a main burner for burning in the combustion chamber.

13. The heating system according to claim 10, further including a feeder that meters the quantity of the ultrafine particles provided to the dedicated burner.

14. The heating system according to claim 10, wherein some of the ultrafine particles are provided by another second dedicated pipe to a dedicated injector that introduces the ultrafine particles into the combustion chamber.

15. The heating system according to claim 14, wherein the ultrafine particles provided to the dedicated injector to introduce the ultrafine particles into the combustion chamber near the main burners.

16. The heating system according to claim 10, wherein the dedicated injector is disposed near a main burner.

17. The heating system according to claim 10, wherein the dedicated injector introduces the ultrafine particles downstream of a main burner.

18. An indirect heating system in which a solid fuel circulates in the form of particles, comprising:

a grinding station that grinds the solid fuel into coarse particles that require re-grinding, fine particles having an average diameter less than course particles, but greater than 75 microns and particles having an average diameter of less than 75 microns referred to as 'ultrafine particles' and releases them as a stream of flowing particles;

a separator receives the stream from the grinding station and intercepts coarse particles from the stream;

at least one cyclone receives the stream from the separator and intercepts the fine particles from the stream;

a first intermediate silo that receives the fine particles for burning in a combustion chamber;

a dust extractor that intercepts the ultrafine particles which are then provided by a dedicated pipe to a dedicated burner for burning in the combustion chamber;

a second intermediate silo that receives the ultrafine particles from the dust extractor, wherein the ultrafine particles are then provided by a dedicated pipe to a dedicated burner for burning in the combustion chamber; and a feeder that controls the amount of ultrafine particles provided from the second intermediate silo to the dedicated burner.

* * * * *